United States Patent [19]

Wynn

[11] 3,969,046

[45] July 13, 1976

[54] METERING PUMP SYSTEM

[76] Inventor: James M. Wynn, 1137 Walpert No. 18, Hayward, Calif. 94541

[22] Filed: July 12, 1974

[21] Appl. No.: 487,960

[52] U.S. Cl. ..... 417/517; 92/13.3; 417/519

[51] Int. Cl.[2] ..... F04B 17/00; F04B 15/00; F04B 23/06

[58] Field of Search.... 417/517, 521, 522, 534–537; 92/13.3, 13.4, 13.5, 13.7

[56] References Cited

UNITED STATES PATENTS

| | | | |
|---|---|---|---|
| 2,807,213 | 9/1957 | Rosen | 92/13.3 X |
| 2,954,737 | 10/1960 | Hoover | 92/13.3 X |
| 3,038,311 | 6/1962 | Lindsley et al. | 417/517 X |
| 3,196,802 | 7/1965 | Matheny | 92/13.3 X |
| 3,289,889 | 12/1966 | Schwieger | 92/13.3 X |
| 3,499,387 | 3/1970 | Zippel | 417/399 |
| 3,612,732 | 10/1971 | Stephans | 92/13.5 X |

*Primary Examiner*—Charles J. Myhre
*Assistant Examiner*—Ira S. Lazarus
*Attorney, Agent, or Firm*—Townsend and Townsend

[57] ABSTRACT

A system for metering and pumping a plurality of fluids is diclosed. The system includes a pumping stage which has a plurality of piston pumps extending from a rigid support to a rack hinged at one end. A valve stage is provided having a valve body with an internal rotatable valve spool. The valve body has several sets of inlet, outlet and common ports communicating with the valve spool, the common ports being connected to the respective pumps. One set of ports is provided for such fluid to be metered and pumped. For each set of ports, the valve spool has a flat portion and a circumferential indentation integral to the flat portion. Alignment of a flat portion of the valve spool with an inlet port of the valve body allows fluid to pass from a supply to the respective pump, and alignment of the flat portion with an outlet port allows the fluid to pass from the pump and out through the outlet port. Means are provided for rotating the valve spool so that the respective fluids are cyclically provided to the respective metering pumps and then allowed to be expelled therefrom.

12 Claims, 10 Drawing Figures

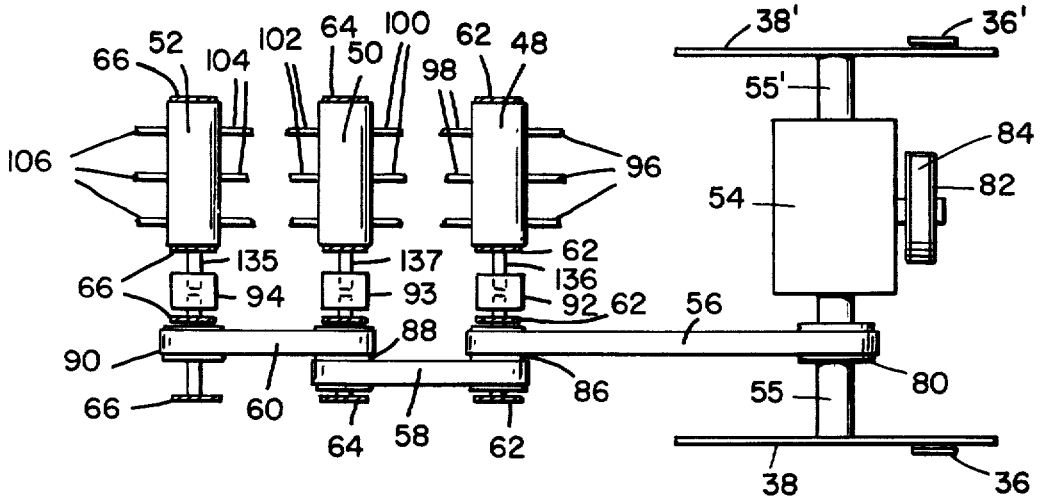
FIG_2
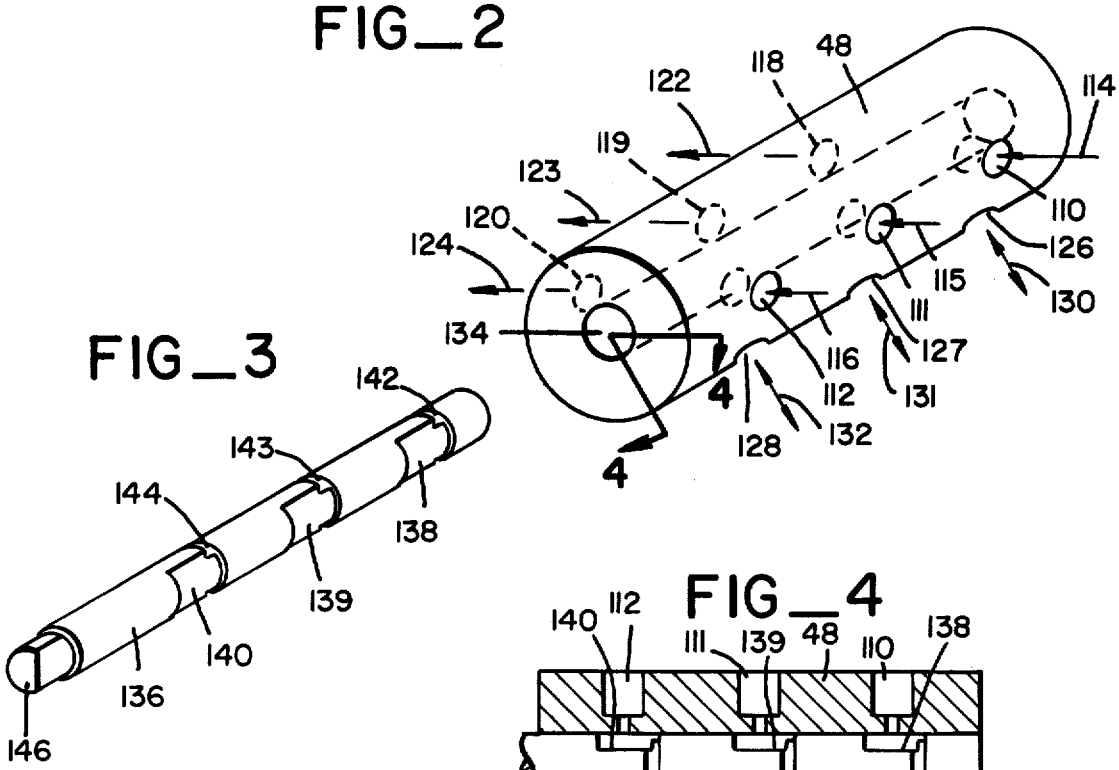
FIG_3
FIG_4
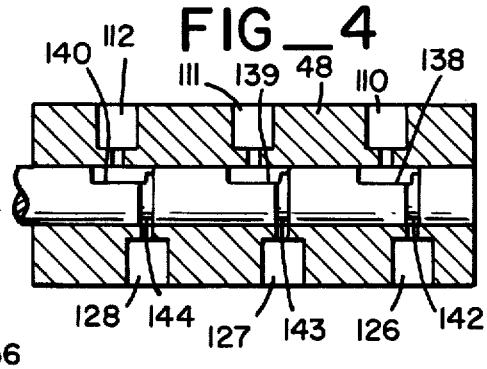
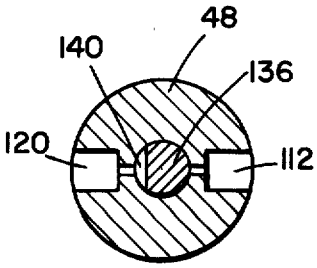
FIG_5
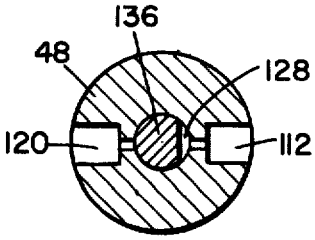
FIG_6
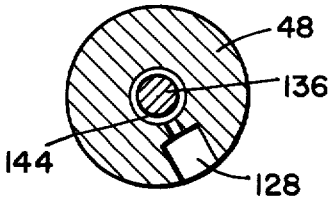
FIG_7

METERING PUMP SYSTEM

BACKGROUND OF THE INVENTION

The present invention relates to a pumping system, and in particular to a system for metering and pumping a plurality of fluids.

The accurate metering of a number of fluids simultaneously is necessary in many applications, such as the development of x-rays, development of color film, and so forth. The relative volumes of the different fluids vary from fractions of a cc, i.e., only two or three drops, to nearly 100 cc's. The fluids must be simultaneously metered and then mixed to perform their processing function, and difficulty has been encountered in developing an automated system which can accurately meter the different volumes of fluids. The most critical problem in this area has been the development of a valve or valve system which can accurately meter very small volumes of the fluid as well as accommodating the larger volumes.

The present invention provides a system for metering and pumping a plurality of fluids having wide volumetric differences. The system includes a pumping stage which has a plurality of piston pumps extending from a substantially rigid support to a rack hinged at one end and having an opposite free end. Each of the pumps is associated with one of the respective fluids, and has an expansion cycle for drawing a pre-selected amount of fluid into the pump and a contraction cycle for pumping the fluid. The amount of fluid drawn into each of the pumps during the expansion cycle depends on the distance of the different pumps from the hinged end of the rack, and the pumps are operated by reciprocating the free end of the rack.

The present invention also includes a valve stage having a valve body with a plurality of sets of externally opening ports communicating with a central passageway. Each set includes an inlet port connected to a fluid supply, an outlet port generally opposed to the inlet port, and a common port connected to one of the respective pumps. A valve spool is rotatably mounted within the passageway and has a flat portion corresponding to the inlet and outlet ports of each set and a circumferential indentation corresponding to the common port of each set and integral to the flat portion corresponding therewith.

A power supply is provided which both reciprocates the free end of the rack and operates the valve stage. A timing belt connects the valve spool to the output shaft of the power supply, and an arm eccentrically mounted to the output shaft is connected to the free end of the rack so that operation of the rack and the valve stage is synchronized.

The present invention provides a positively acting mechanical valve rather than passive check valves which are normally found in the prior art. Such check valves are reasonably accurate for relatively large volumes of fluid, greater than a few cc's, but are often inaccurate for fractions of a cc. Such small volumes consist of only a few drops of fluid, and air bubbles can be formed between the drops which destroys the accuracy of the system. Attempts have been made to have two check valves for greater accuracy, but this results in a lower closing pressure exerted on each of the check valves and thus decreases the reliability of the closure.

The mechanical valve arrangement of the present invention allows for the use of a common line leading to the pump, rather than separate feed and return lines as used previously. Besides simplifying the overall system, less fluid remains in the lines so that greater accuracy can be attained in the metering of the fluids, particularly in regard to small volumes. The present invention provides a relatively simple valve system which is still highly accurate, and is thought to be much more accurate than devices found in the prior art.

The apparatus of the present invention allows for a great deal of flexibility in not only the range of volumes metered, but also in the selection of the volumes of each fluid. In a preferred embodiment of the present invention, the pumps are movable along the rack so that their distance from the hinged end of the rack is variable, resulting in a variation in the amount of fluid metered by the respective pumps. Pumps of different sizes can be employed to extend the range of the metering capacity of the apparatus. Also, the speed of the reciprocation of the rack can be varied to alter the volumetric flow of the fluids in unison without changing their relative proportions. The valve stage is operated in synchronization with the rack so that such variation in speed is automatically reflected in the operation of the valve stage.

The novel features which are characteristic of the invention, both as to organization and method of operation, together with further objects and advantages thereof, will be better understood from the following description considered in connection with the accompanied drawings which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 2 is a fragmentary cross-sectional view taken along lines 2—2 of FIG. 1;

FIG. 3 is an exploded view of the valve stage of the present invention;

FIG. 4 is a cross-sectional view taken along lines 4—4 of FIG. 3;

FIG. 5 is a cross-sectional view taken through the inlet and outlet ports of the valve assembly;

FIG. 6 is a view similar to that of FIG. 5 showing the valve spool of the present invention in an alternate configuration;

FIG. 7 is a cross-sectional view of the valve assembly taken through the common port;

DESCRIPTION OF THE PREFERRED EMBODIMENT

Figure 1:
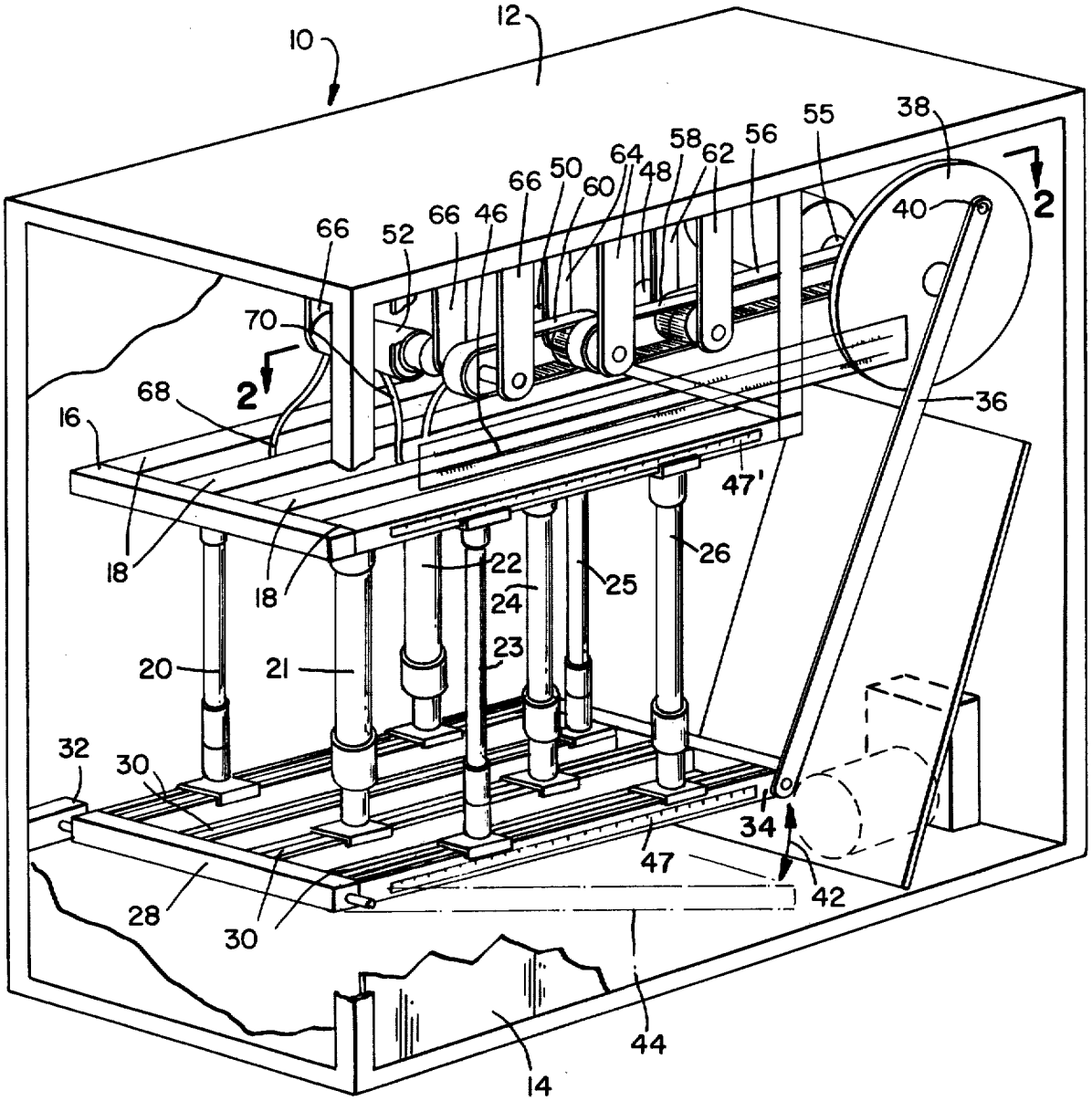
FIG. 1 is a perspective view of the apparatus of the present invention.

The apparatus of the present invention is illustrated generally at 10 in FIG. 1. Apparatus 10 includes a case 12 having glass sides such as 14 allowing visual access to the interior of the case. A fixed support 16 having a plurality of transversely extending brackets 18 is mounted to the upper wall of case 12. A plurality of piston pumps 20–26 are attached to the various brackets 18 of member 16 and extend downwardly as illustrated. Pumps 20–26 vary in diameter but their lengths are equal. The lower ends of pumps 20–26 are connected to the respective brackets 30 of rack 28. One end of rack 28 is connected by a hinge 32 to the side of case 12. The other end 34 of rack 28 is free and is pivotable about hinge 32. One end of an arm 36 is connected to free end 34 of rack 28, the other end of the arm connected to a radial plate 38 at 40 so that the arm is eccentrically mounted to the radial plate. Rotation of radial plate 38 thus causes rack 28 to move upwardly and downwardly in a reciprocating motion as illustrated by arrows 42. Radial plate 38 is mounted at the end of the power output shaft 55 which rotates to reciprocate the rack and thereby operate piston pumps 20–26 by alternately expending and contracting them.

The spacing of the respective pumps 20–26 from the hinged end 32 of rack 28 controls the stroke of the pistons. Assuming that the diameter or bore of the piston pumps is fixed, the stroke of the piston controls the volume of fluid metered by each cycle of the pump. A table 46 is provided on glass side 14 of case 12, and a corresponding scale 47 is provided along the side of rack 28. Table 46 indicates the correct setting on scale 47 to achieve the desired volumetric flow for a given diameter pump, and pumps 20–26 can be moved along support 16 and rack 28 to the desired setting. In one test model of the present invention, a pump having a 5/16 inch piston diameter is adjustable from volumes as low as 0.31 cc to 7.25 cc by moving it along scale 47. A ¾ inch diameter pump has a range from 2.26 cc to 52.5 cc, and a one inch diameter pump has a range from 4.03 cc to 93.67 cc. Hence, by varying the diameters of the pumps and moving the various pumps along scale 47, the apparatus is capable of metering volumes as low as a third of a cc and almost as high as 100 cc.

A plurality of valve bodies 48, 50, and 52 are suspended from the top of case 12 by brackets 62, 64, and 66. Valve bodies 48–52 have a plurality of common lines such as 68, 70 extending to the respective pumps 20–26. Also, valve bodies 48–52 have lines leading to sources of fluid supply and to a manifold for mixing the metered fluids (not shown).

Valve bodies 48–52 are driven by a series of timing belts 56, 58, 60 serially emanating from power output shaft 55 as illustrated in more detail by way of reference to FIG. 2 which shows the valve stage of the present invention. Timing belt 56 is connected to a timing gear 80 on power output shaft 55 from reducer 54. Shaft 55 and corresponding shaft 55' emanating from the opposite side of reducer 54 are driven by belt 84 on pulley 82 leading to an electric or other type of motor. As an alternative embodiment, element 54 could be an electric or other type of motor and supply power directly to power output shafts 55 and 55'. Radial plates 38, 38' are mounted at the opposite ends of shafts 55, 55'and arms 36, 36' are eccentrically mounted thereto as illustrated previously. Thus, operation of valves 48, 50, and 52 are synchronized with the operation of the piston pumps and both are powered by the same source.

Valve bodies 48, 50, and 52 each have respective valve spools 136, 137, and 135 projecting partially outwardly from the interior of the valve body. Such valve spools 136, 137, and 135 are connected by means of nylon couplers 92–94 respectively to pulleys 86, 88, and 90 which are engaged by timing belts 56–60. In this manner, the valves are operated by the sequence of timing belts and all operate in synchronization with the piston pumps illustrated previously. Valve body 48 has a plurality of inlet tubes 96 and corresponding outlet tubes 98 so that the valve body is capable of monitoring the flow of three separate fluids. Similarly, valve body 50 has three inlets 100 and three outlets 102, and valve body 52 has three inlets 104 and three outlets 106, so that each valve body is capable of handling three individual fluids, and the valve assembly shown in capable of handling nine separate fluids. In the embodiment illustrated herein, only seven piston pumps are available so that two inlet and outlet tubes are extraneous. The extraneous inlet and outlet tubes can either be capped or can be used as supplements to larger piston pumps to facilitate the volumetric flow of the larger pumps.

One of the valve bodies 48 is illustrated in more detail by way of reference to FIG. 3. Valve body 48 has a plurality of outwardly opening inlet ports 110, 111, and 112 into which fluid is adapted to flow, as illustrated by arrows 114–116. Corresponding outlet ports 118, 119, and 120 are provided on the opposite side of valve body 48, and are disposed approximately 180° from the inlet ports. Fluid is adapted to flow out of the outlet ports 118–120, as illustrated by arrows 122–124. Externally opening common ports 126, 127, and 128 are also provided in valve body 48 so that the valve body has three complete sets of ports, each set including an inlet port, an outlet port, and a common port. Common ports 126–128 are connected to the respective piston pumps, and the fluid is adapted to flow both to the piston pumps and from the piston pumps through the common ports, as illustrated by arrows 130–132.

The flow of fluids through valve body 48 is controlled by means of valve spool 136. Valve spool 136 is rotatable within a radially symmetric passageway 134 in valve body 48. The side walls of valve spool 136 are adapted to generally conform to the interior walls of passageway 134 to prevent leakage of the fluids through passageway 134. Valve spool 136 and passageway 134 are generally cylindrical in the embodiment illustrated, but other shapes could be used, particularly if valve body 48 were laminated. A plurality of flat portions 138, 139, and 140 are formed in the side of valve spool 136, and correspond with the respective inlet ports 110–112 as illustrated in FIG. 4, and also with outlet ports 118–120. Circumferential indentations 142–144 are formed in valve spool 136 corresponding with each flat portion 138–140 and are integral therewith to allow fluid communication therebetween within passageway 134 in valve body 48.

Referring to FIG. 4, when a flat portion such as 140 of valve spool 136 is aligned with an inlet port such as 112 in valve body 48, fluid can flow through the inlet port, by-passing valve spool 136 through flat spot 140 and circumferential indentation 144, and out common port 128 to lead to one of the respective piston pumps. Similarly, alignment of the flat spot with one of the outlet ports allows fluid communication from the common port to the outlet port.

Alignment of the flat portion 140 of valve spool 136 with an outlet port 120 is illustrated in FIG. 5. It is apparent that fluids may flow from the space adjacent flat portion 140 to outlet port 120, but that inlet port 112 is sealed and fluids cannot flow therethrough. Referring to FIG. 6, valve spool 136 is rotated 180° so that flat portion 140 is aligned with inlet port 112. Fluids now may flow through inlet port 112 into the space adjacent flat portion 140, but outlet port 120 is sealed. Referring to FIG. 7, it is apparent that common port 128 in valve body 48 is in constant communication with the space adjacent circumferential indentation 144 in valve spool 136. As a result, fluids can flow through the inlet port and out the common port when the flat portion 140 of valve spool 136 is aligned with the inlet port, and fluids can flow through the common port and out the exit port 120 when the flat portion of the valve spool is aligned therewith, allowing for the use of a single common port connected to each respective piston pump.

Figure 8:
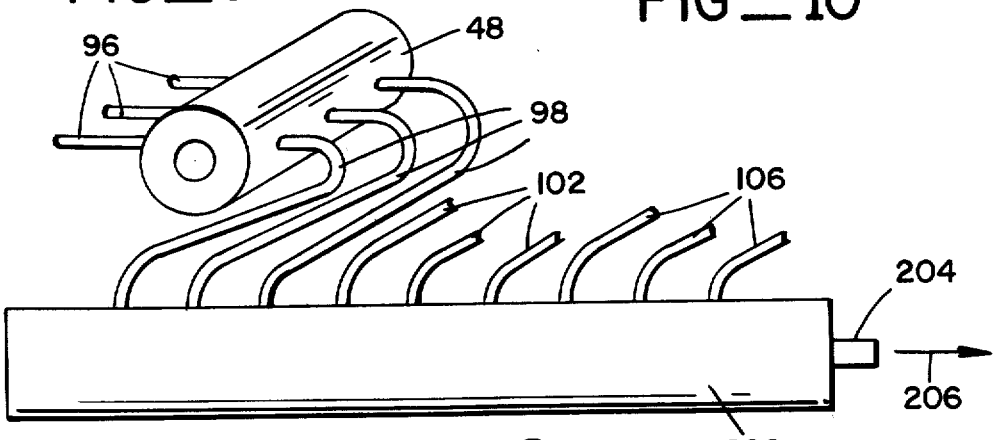
FIG. 8 is a fragmentary view showing the manifold assembly of the present invention.

Three fluids are controlled by each valve body 48 by the three sets of ports therein. It has been found that manufacturing tolerances restrict the length of the valve body so that the number of fluids controlled by each valve body is limited, and several valve bodies may be required. The fluids enter through inlet tubes 96 and, after metering, are pumped through outlet tubes 98. As illustrated in FIG. 8, outlet tubes such as 98 emanating from valve body 48, and outlet tubes 102 and 106 emanating from other valve bodies can be connected to a single manifold 200 in which they are mixed. The mixed fluids pass out of manifold 200 through a tube 204 as illustrated by arrow 206 for use of the mixed fluids. In certain applications, it may be desirable to mix certain of the metered fluids in one manifold, and other metered fluids in a different manifold to provide two mixtures. It is apparent such variations can easily be accommodated by the teachings of the present invention, which allows for the metering and pumping of a wide variety of different fluids for various applications.

Figure 9:
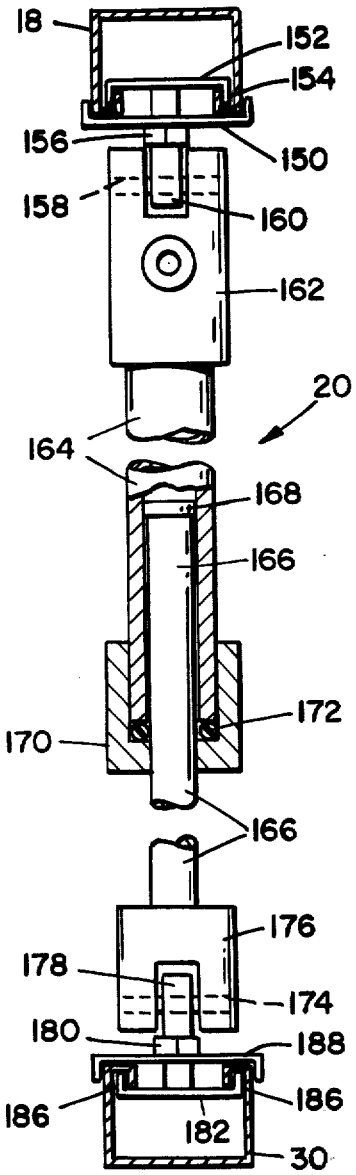
FIG. 9 is an end elevation view of one of the piston pumps of the present invention.
Figure 10:
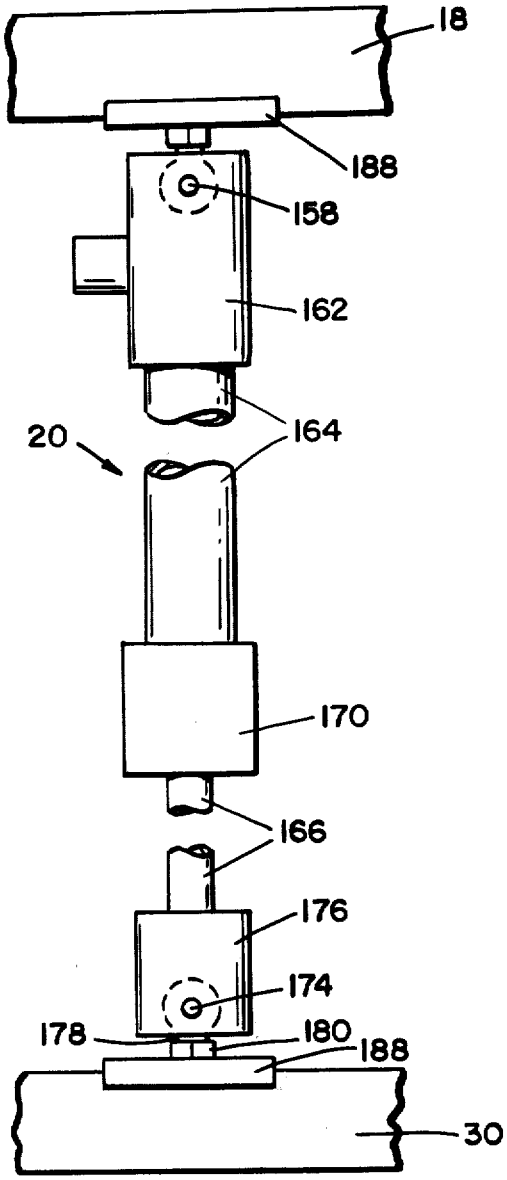
FIG. 10 is a side elevation view of one of the piston pumps of the present invention.

The construction of a piston pump such as 20 of the present invention and its attachment to the respective upper and lower brackets 18 and 30 of the support member and rack are illustrated by way of reference to FIGS. 9 and 10. Bracket 18 is generally U-shaped and has an inwardly directed space defining a lip 154. A channel member 152 is adapted to mate with lip 154. A complementary channel member 150 is adapted to fit over the open end of bracket 18, and can be biased against the bracket by nut 156 so that shaft 160 forming the upper end of piston pump 20 rigidly engages bracket 18.

A nylon section 162 forms the upper end of the cylinder portion 164 of piston pump 20. Nylon section 162 is connected by means of pin 158 to shaft 160 so that the piston pump is pivotable with respect to bracket 18 about a transverse axis. A piston 166 having head 168 is adapted to fit within cylinder 164. A fluid-tight seal is maintained between piston 166 and cylinder 164 by means of an O-ring 172 disposed at the lower end 170 of cylinder 164, rather than having piston rings or other sealing means at the upper end of the piston. This construction is relatively easy to manufacture and any failure in the seal of O-ring 172 resulting in blow-by past the O-ring is easily visible by fluid dripping down the exposed exterior of piston 166.

The lower end 176 of piston 166 is pivotably connected to shaft 178 by pin 174. Nut 180 on shaft 178 is adapted to bias complementary U-shaped members 182, 188 together against lip 186 formed in bracket 30. Thus, the lower end of piston 20 is pivotably attached about a transverse axis to the reciprocating rack. However, piston 20 can easily be detached from bracket 30 by loosening nut 180 for sliding movement of the piston along the rack, allowing for easy adjustment of the piston to any volumetric flow desired.

In operation, a plurality of pumps such as 20–26 are provided so that one pump is provided for each fluid to be metered. Relatively large pumps are selected for those fluids wherein larger volumes are to be metered, and smaller pumps for smaller volumes to be metered. The exact amount of fluid to be metered in each pump stroke for the respective pumps is pre-selected by placing the pumps along support 16 and rack 28 corresponding to the appropriate position on scale 47 as indicated by chart 46. In the embodiment illustrated, the positions of the pumps are variable, but it may be desirable to permanently fix their positions in some applications after they have once been located.

After each pump such as 20–26 has been properly positioned, the piston chamber is connected to a common port in one of the valve bodies 48–52 by means of a tube such as 68. Each valve body 48–52 has several sets of ports, each set including a common port such as 126, an inlet port such as 110, and an outlet port such as 118. Inlet port 110 is connected to the supply of the associated fluid, and outlet port 118 is connected to a manifold such as 200 wherein the various fluids are mixed if desired. (The fluids may also be used individually in some applications.)

Actuation of reducer (or motor) 54 causes the free end 34 of rack 28 to be moved upwardly and downwardly in a reciprocating motion to expand and contract pumps 20–26 and operate the pump stage. Simultaneously, valve spools 135–137 are rotated to operate the valve stage. Each of the valve spools have flat portions such as 138 which serially align first with the inlet port such as 110 and then with the outlet port such as 118. A circumferential indentation in valve spool such as 136 is integral to the flat portion 138 and provides continuous communication from the common port such as 136 to the flat portion of the valve spool. Thus, alignment of flat portion such as 138 with the inlet port allows fluid to flow through the valve body and to the pump during the expansion cycle of the pump. Correspondingly, alignment of the flat portion with the outlet port allows the fluid to flow from the pump through the valve body and out the outlet port during the contraction cycle of the pump.

The apparatus of the present invention is adapted primarily for use with piston pumps having a piston which reciprocates linearly in a cylindrical chamber. However, it is apparent that the apparatus of the present invention is applicable to any type of pump which is actuated by generally linear reciprocating motion and whose flow rate is proportional to its stroke. It is to be expressly understood that the term "piston pump" when used herein specifically includes all pumps which are actuated by generally linear reciprocating means.

While a preferred embodiment of the present invention has been illustrated in detail, it is apparent that modifications and adaptations of that embodiment may occur to those skilled in the art. For example, the teachings of the present invention are readily adaptable to single-pump systems. However, it is to be expressly understood that such modifications and adaptations are within the spirit and scope of the present invention, as set forth in the following claims.

What I claim as new is:

1. A system for metering and pumping a plurality of fluids, said system comprising:

a pumping stage including a plurality of piston pumps extending from a substantially rigid support to a rack hinged at one end and having an opposite free end, each pump associated with one of the respective fluids, each said pump having an expansion cycle for drawing a pre-selected amount of fluid into the pump and a contraction cycle for pumping the fluid, the amount of fluid drawn into each of the pumps during the expansion cycle depending on the distance of the different pumps from the hinged end of the rack;

a valve stage comprising a valve body having a plurality of sets of externally opening ports communicating with a central passageway, each set including an inlet port, an outlet port generally opposed to the inlet port and a common port connected to one of the respective pumps, and a valve spool rotatably mounted within the passageway and having a flat portion corresponding to the inlet and outlet ports of each said set of ports and a circumferential indentation corresponding to the common port of each set and integral to the flat portion corresponding therewith; and power supply means adapted to reciprocate the free end of the rack and to operate the valve stage in synchronization with the reciprocation of the rack to pump metered amounts of the respective fluids, said power supply means adapted to rotate the valve spool so that the flat portion corresponding to each set of ports is serially aligned with the inlet port and then the outlet port to first allow fluid to pass to the pumps and then allow fluid to be discharged from the pumps.

2. A system as recited in claim 1 wherein the piston pumps are movable along the rack to allow variation of the amount of fluid to be drawn into each of the pumps.

3. A system as recited in claim 1 wherein the power supply means includes an output shaft, a timing gear mounted to said output shaft, a timing belt connecting the valve spool to the timing gear, and an arm eccentrically attached to the output shaft and connected to the free end of the rack so that the valve stage and the pumping stage are operated in synchronization.

4. A system as recited in claim 1 and additionally comprising a manifold in communication with the valve stage and adapted to receive the fluids expelled from the respective pumps for mixing said fluids.

5. A system for metering and pumping a plurality of fluids, said system comprising:

a pumping stage including at least one metering pump;

a valve body having one or more sets of externally opening ports communicating with a radially symmetric passageway, each set including an inlet port adapted to be connected to a fluid supply, an outlet port generally opposed to the inlet port, and a common port adapted to be connected to one of the pumps of the pump stage;

a valve spool adapted to fit within the passageway in the valve body and rotatable relative thereto, said spool having a flat portion corresponding to each set of inlet and outlet ports respectively and a circumferential indentation corresponding to the common port of each set and integral to the flat portion corresponding therewith so that alignment of the flat portion with the corresponding inlet port allows fluid to pass from the fluid supply through the valve body and out of the common port to the metering pump, and alignment of the flat portion with the corresponding outlet port allows fluid to pass from the pump through the common port and out the outlet port; and means for rotating the valve spool so that the respective fluids are cyclically provided to the respective metering pumps and then allowed to be expelled therefrom.

6. A system as recited in claim 5 wherein the pump stage includes a plurality of metering pumps and wherein the valve body includes a plurality of sets of ports associated with the respective pumps.

7. A system as recited in claim 6 wherein the metering pumps of the pump stage comprise piston pumps extending from a substantially rigid support to a rack hinged at one end and having an opposite free end, said pumps being operated by reciprocating movement of the rack about its hinged end, the amount of fluid supplied to each of the pumps depending on the distance of the different pumps from the hinged end of the rack.

8. A system as recited in claim 6 and additionally comprising a plurality of discrete valve bodies each having two or more sets of ports, and a valve spool associated with each such valve body, and wherein the rotating means comprises means for rotating each of the valve spools in synchronization.

9. A system for metering and pumping a plurality of fluids, said system comprising:

an elongate support member;

a plurality of piston pumps aligned in a common plane, each piston pump having one end adapted to be attached to the elongate support member and extending from the support member in a common direction, said piston pumps having varying capacities;

an elongate rack member having the other ends of the piston pumps adapted to be attached thereto, said rack member having one hinged end and one free end so that the rack member is pivotable about the hinged end, the piston pumps being attached along the length of the rack member selected distances from the hinged end of the rack for control of the volume of fluid metered and pumped by the respective pumps when operated by reciprocating movement of the rack;

means for detachably attaching the respective ends of the piston pumps to the elongate support member and the elongate rack member for adjustment of the pumps along said members in said common plane to control and adjust the amount of fluid metered by each respective pump; and means for reciprocating the free end of the rack member to operate the respective piston pumps to meter and pump the respective fluids in preselected quantities determined by the capacities of the respective pumps and the position of the pumps along the support and rack members.

10. A system as recited in claim 9 wherein the other ends of the piston pumps are individually movable along the rack to allow selection of the volume of fluid metered and pumped by the respective pumps.

11. A system as recited in claim 9 wherein the reciprocating means include a power output shaft, and an arm eccentrically mounted to the power output shaft and attached to the free end of the rack.

12. A system as recited in claim 11 and additionally comprising a valve stage having a plurality of sets of valve stations, one valve station corresponding to each of the fluids respectively and adapted to allow passage of the fluids to the respective pumps during their expansion stage and allow the fluids to be expelled from the pumps during their contraction stage, a timing gear on the power output shaft, and timing belt means extending from the timing gear to the valve stage to synchronize operation of the valve stage with the operation of the pumps.

* * * * *